US007712742B1

(12) United States Patent
Russell

(10) Patent No.: US 7,712,742 B1
(45) Date of Patent: May 11, 2010

(54) GAME OF CHANCE

(75) Inventor: Christopher Russell, Gaithersburg, MD (US)

(73) Assignee: CCI Entertainment, LLC, Chesapeake Beach, MD (US)

( * ) Notice: Subject to any disclaimer, the term of this patent is extended or adjusted under 35 U.S.C. 154(b) by 0 days.

(21) Appl. No.: 12/315,012

(22) Filed: Nov. 26, 2008

(51) Int. Cl.
*A63F 3/06* (2006.01)

(52) U.S. Cl. ..... 273/269; 273/274

(58) Field of Classification Search ..... 273/139, 273/269, 274
See application file for complete search history.

(56) References Cited

U.S. PATENT DOCUMENTS 6,368,214 B1 * 4/2002 Luciano ..... 463/18
7,255,349 B1 * 8/2007 Hynes ..... 273/269
7,533,885 B2 * 5/2009 Nicely et al. ..... 273/142 R
7,540,498 B2 * 6/2009 Crenshaw et al. ..... 273/274
7,562,875 B2 * 7/2009 Morin et al. ..... 273/269
7,566,058 B1 * 7/2009 Itkis ..... 273/269

* cited by examiner

*Primary Examiner*—William M Pierce
(74) *Attorney, Agent, or Firm*—Paul E Schaafsma

(57) ABSTRACT

In accordance with the principles of the present invention, a game of chance is provided. Cards for use in the game of chance have rows and columns that define "boxes having numbers contained in the boxes. A random number generator generates an initial number of numbers, preferably two. The initial numbers correspond to the numbers contained in the boxes, thus representing a numerical spread based on the position the numbers correspond to on the card. Depending on the numerical spread based on the position the numbers correspond to on the card, either a payoff is determined, a push is called or at least an addition number is generated. If the additional number is generated, either a payoff is determined or a push is called.

12 Claims, 1 Drawing Sheet

| | | | | | | | | | | | | | | | | | |
|---|---|---|---|---|---|---|---|---|---|---|---|---|---|---|---|---|---|
| B | 1 | 2 | 3 | 4 | 5 | B | 6 | 7 | 8 | 9 | 10 | B | 11 | 12 | 13 | 14 | 15 |
| I | 16 | 17 | 18 | 19 | 20 | I | 21 | 22 | 23 | 24 | 25 | I | 26 | 27 | 28 | 29 | 30 |
| N | 31 | 32 | 33 | 34 | 35 | N | 36 | 37 | 38 | 39 | 40 | N | 41 | 42 | 43 | 44 | 45 |
| G | 46 | 47 | 48 | 49 | 50 | G | 51 | 52 | 53 | 54 | 55 | G | 56 | 57 | 58 | 59 | 60 |
| O | 61 | 62 | 63 | 64 | 65 | O | 66 | 67 | 68 | 69 | 70 | O | 71 | 72 | 73 | 74 | 75 |

| | | | | | | | | | | | | | | | | | |
|---|---|---|---|---|---|---|---|---|---|---|---|---|---|---|---|---|---|
| B | 1 | 2 | 3 | 4 | 5 | B | 6 | 7 | 8 | 9 | 10 | B | 11 | 12 | 13 | 14 | 15 |
| I | 16 | 17 | 18 | 19 | 20 | I | 21 | 22 | 23 | 24 | 25 | I | 26 | 27 | 28 | 29 | 30 |
| N | 31 | 32 | 33 | 34 | 35 | N | 36 | 37 | 38 | 39 | 40 | N | 41 | 42 | 43 | 44 | 45 |
| G | 46 | 47 | 48 | 49 | 50 | G | 51 | 52 | 53 | 54 | 55 | G | 56 | 57 | 58 | 59 | 60 |
| O | 61 | 62 | 63 | 64 | 65 | O | 66 | 67 | 68 | 69 | 70 | O | 71 | 72 | 73 | 74 | 75 |

FIG. 1

| | | | | | | | | | | | | | | | |
|---|---|---|---|---|---|---|---|---|---|---|---|---|---|---|---|
| B | 1 | 2 | 3 | 4 | 5 | 6 | 7 | 8 | 9 | 10 | 11 | 12 | 13 | 14 | 15 |
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |

FIG. 2

GAME OF CHANCE

FIELD OF THE INVENTION

The present invention relates to games of chance.

BACKGROUND OF THE INVENTION

Games of chance provide entertainment to many. A game of chance is a game whose outcome is strongly influenced by some randomizing device, and upon which contestants frequently wager money. Common devices used include dice, spinning tops, playing cards, roulette wheels or numbered balls drawn from a container. Gambling is known in nearly all human societies. Early people used the knucklebones of sheep as dice. Some games of chance may also involve a certain degree of skill. This is especially true where the player or players have decisions to make based upon previous or incomplete knowledge, such as poker and blackjack.

Bingo is a game of chance in which randomly selected numbers are drawn and players match those numbers to those appearing on 5×5 matrices which are printed or electronically represented and are known as "cards." The first person to have a card where the drawn numbers form a specified pattern (usually in a straight line) is the winner and calls out the word "bingo" to alert others and inform the caller of the win.

Bingo has been traced back to a lottery game called "Lo Giuoco Code Loto" played in Italy in the 1500's. By the eighteenth century, the game had matured, and in France, playing cards, tokens, and the calling out of numbers had been added to the game. In the nineteenth century, Bingo was widely used in Germany for educational purposes, to teach children spelling, animal names, and multiplication tables.

At a travelling carnival near Atlanta in 1929, Beano was being played with dried beans, a rubber stamp, and cardboard sheets. Edwin Lowe was watching this game and noticed how engaged the players were. Lowe took the idea with him to New York, where he introduced the game to his friends. He conducted bingo games similar to the ones he had witnessed, using dried beans, a rubber numbering stamp and card board. His friends loved the game. Folklore has it that one of his players made bingo history when he was so excited to have won that he yelled out "Bingo" instead of "Beano", and the name stuck. The Lowe Bingo Game had two versions: the first a 12-card set for $1.00; the second a $2.00 set with 24 cards. Bingo was a wildly successful. By the 1940's, Bingo games were common all over the country.

In the U.S., the game is primarily staged by churches or charity organizations. Their legality and stakes vary by state regulation. In some states, bingo halls are rented out to sponsoring organizations, and such halls often run games almost every day. Church-run games, however, are normally weekly affairs held on the church premises. These games are usually played for modest stakes, although the final game of a session is frequently a coverall game that offers a larger jackpot prize for winning within a certain quantity of numbers called; a progressive jackpot may increase per session until it is won.

Commercial bingo games in the U.S. are primarily offered by casinos (for example in the state of Nevada), and by Native American bingo halls, which are often housed in the same location as Native American casinos. In Nevada, bingo is usually offered only by casinos that cater to local gamblers, and not tourist resorts. Nevada bingo halls usually offer several two-hour sessions daily, with relatively modest stakes except for coverall jackpots. Native American games are typically offered for only one or two sessions a day, and are often played for higher stakes than charity games in order to draw players from distant places. Some also offer a special progressive jackpot game that may tie together players from multiple bingo halls.

While such bingo games continue to offer entertainment to many, player who have now for decades been playing the game often tire of it. Thus, what would be advantageous would be a new game that takes advantage of the familiarity of bingo to players, but yet provides a new, exciting gaming experience.

SUMMARY OF THE INVENTION

A game of chance in accordance with the principles of the present invention takes advantage of the familiarity of bingo to players, but yet provides a new, exciting gaming experience. In accordance with the principles of the present invention, a game of chance is provided. Cards for use in the game of chance have rows and columns that define "boxes having numbers contained in the boxes. A random number generator generates an initial number of numbers, preferably two. The initial numbers correspond to the numbers contained in the boxes, thus representing a numerical spread based on the position the numbers correspond to on the card. Depending on the numerical spread based on the position the numbers correspond to on the card, either a payoff is determined, a push is called or at least an addition number is generated. If the additional number is generated, either a payoff is determined or a push is called.

BRIEF DESCRIPTION OF THE DRAWING

The foregoing aspects and many of the advantages of the present invention will be more readily appreciated as the same becomes better understood by reference to the following detailed description, when taken in conjunction with the accompanying drawings, wherein:

FIG. 1 shows an example of a card for use in a game of chance in accordance with the principals of the present invention.

FIG. 2 shows a second example of a card for use in a game of chance in accordance with the principals of the present invention.

DETAILED DESCRIPTION OF A PREFERRED EMBODIMENT

In accordance with the principles of the present invention, game of chance is provided. A game of chance in accordance with the principles of the present invention takes advantage of the familiarity of bingo to players, but yet provides a new, more exciting gaming experience. Referring to FIGS. 1 and 2, examples of cards for use in a game of chance in accordance with the principals of the present invention is seen. Up to a given number, such as for example eight, players can buy in. Buy-in will typically have a minimum buy-in such as for example $1.00 and a maximum buy-in such as for example $20.00. Each player can mark and monitor up to a given number of cards, such as for example three, at their player position. The caller draws and calls a given number of numbers, such as for example two. All numbers drawn are valued in a given numerical spread based on the first number in each column the number falls under on the card, such as for example in FIGS. 1 and 2 one to 15.

If the first numbers called, in this example two, are in consecutive columns, then the game is voided; if the first numbers called, in this example two, are equal, then an additional number is drawn and called. A matching additional number is a jackpot, and all the players win a given payout such as for example eleven times their buy-in; otherwise, the game is a push and player's buy-in is returned.

If the first numbers called, in this example two, are consecutive in columns (for example a thirty-four and fifty), the game is a push and the player's buy-in is returned. If the first numbers called, in this example two, are in the same column, then an additional number is drawn and called. If the additional number is in the same column, then all the players win a jackpot, and all the players win a given payout such as for example eleven times their buy-in; otherwise, the game is a push and the player's buy-in is returned.

If the first numbers called, in this example two, are in columns with a difference greater than one (for example, a three and an eight), then a spread is announced which determines the payoff, pending the outcome of an additional number which will be dealt. If this additional card's value falls between the first two numbers, the player receives a payoff according to the spread; otherwise, the bet is lost. In one aspect, players have an option to increase their buy-in after the first numbers are chosen, for example, doubling their buy-in. In one embodiment, the spread can be as set forth in the table, below:

TABLE

| Column Differential | Spread |
|---|---|
| 1 Column | 5X Buy-In |
| 2 Columns | 4X Buy-In |
| 3 Columns | 3X Buy-In |
| 4+ Columns | 1X Buy-In |

The following are non-limiting examples of the present invention:

Example 1

In this example, the caller draws and calls two numbers, say 7 and 8. Because as seen in FIGS. 1 and 2 these two numbers are in consecutive columns, the game is a push and player's buy-in returned.

Example 2

In this example, the caller draws and calls two numbers, say 16 and 16. Because these two numbers are equal, an additional number is drawn and called, say 16. Because this additional number matches the first two, a jackpot is declared and all the players win a given payout such as for example eleven times their buy-in; had the number been other than 16, the game would have been a push and player's buy-in returned.

Example 3

In this example, the caller draws and calls two numbers, say 22 and 68. Because the two numbers are consecutive in columns, the game is a push and the player's buy-in is returned.

Example 4

In this example, the caller draws and calls two numbers, say 22 and 37. Because the two numbers are in the same column, an additional number is drawn and called, say 67. Because the additional number is in the same column, then all the players win a jackpot, and all the players win a given payout such as for example eleven times their buy-in; had the additional number not been in the same column, the game would have been a push and player's buy-in returned.

Example 5

In this example, the caller draws and calls two numbers, say 22 and 55. Because the two numbers are in columns with a difference greater than one, then a spread is announced which determines the payoff, pending the outcome of an additional number which will be dealt. In this example, based on the Table above, the spread would be two-times the buy-in. In addition, in one aspect, players would have an option to increase their buy-in after the first numbers are chosen, for example, doubling their buy-in. If the additional card's value falls in a column between 22 and 55, say 9, the player receives a payoff according to the spread; otherwise, the bet is lost.

While the invention has been described with specific embodiments, other alternatives, modifications, and variations will be apparent to those skilled in the art. Accordingly, it will be intended to include all such alternatives, modifications and variations set forth within the spirit and scope of the appended claims.

What is claimed is:

1. A method of playing a game of chance comprising:

defining a number of "boxes" having numbers on a card having rows and columns;

generating an initial number of numbers;

corresponding the initial numbers to the numbers contained in the boxes;

determining a numerical spread based on the position the numbers correspond to on the card;

depending on the numerical spread based on the position the numbers correspond to on the card, either determining a payoff, calling a push or generating at least an addition number; and if the additional number is generated, either determining a payoff or calling a push.

2. The method of playing a game of chance of claim 1 further including basing the numerical spread on the horizontal position the numbers correspond to on the card columns.

3. The method of playing a game of chance of claim 1 further including generating two initial numbers.

4. The method of playing a game of chance of claim 1 further wherein if the numerical spread based on the position the initial numbers correspond to on the card are consecutive, calling a push.

5. The method of playing a game of chance of claim 1 further wherein if the initial numbers are equal, generating at least an addition number.

6. The method of playing a game of chance of claim 5 further wherein if the addition number is equal to the initial numbers, determining a payoff.

7. The method of playing a game of chance of claim 1 further wherein if the initial numbers are equal, generating at least an addition number.

8. The method of playing a game of chance of claim 1 further wherein if the numerical spread based on the position the initial numbers correspond to on the card is zero, generating at least an addition number.

9. The method of playing a game of chance of claim 8 further wherein if the numerical spread based on the position of the additional number with respect to the initial numbers is zero, determining a payoff.

10. The method of playing a game of chance of claim 1 further wherein if the numerical spread based on the position the initial numbers correspond to on the card is greater than one, then a spread is determined which determines the payoff pending at least an addition generated number.

11. The method of playing a game of chance of claim 10 further wherein if the numerical spread based on the position of the additional number falls between the initial numbers, determining a payoff based on the announced spread.

12. The method of playing a game of chance of claim 10 further wherein determining a spread in accordance with the following:

| Column Differential | Spread |
|---|---|
| 1 Column | 5X Buy-In |
| 2 Columns | 4X Buy-In |
| 3 Columns | 3X Buy-In |
| 4+ Columns | 1X Buy-In. |

* * * * *